United States Patent [19]

Underwood

[11] 4,170,420

[45] Oct. 9, 1979

[54] FLUID MIXING SYSTEM

[76] Inventor: Gene E. Underwood, 4815 W. Yellowstone, Casper, Wyo. 82601

[21] Appl. No.: 810,590

[22] Filed: Jun. 27, 1977

Related U.S. Application Data

[63] Continuation-in-part of Ser. No. 722,668, Sep. 13, 1976, abandoned.

[51] Int. Cl.[2] ..... B01F 15/02; B01F 5/10

[52] U.S. Cl. ..... 366/137; 366/165

[58] Field of Search ..... 366/27, 40, 51, 131, 366/159, 165, 173, 176, 177, 28, 34, 137, 136, 166, 172

[56] References Cited

U.S. PATENT DOCUMENTS

| | | | |
|---|---|---|---|
| 1,192,478 | 7/1916 | Vandercook | 366/165 |
| 1,436,700 | 11/1922 | Eliel | 366/173 |
| 1,669,962 | 5/1928 | Wihlfahrt | 366/173 |
| 1,706,418 | 3/1929 | Sissom | 366/173 |
| 1,986,019 | 1/1935 | Shaffner | 259/95 |
| 2,322,087 | 6/1943 | Atwood | 259/95 |
| 2,432,175 | 12/1947 | Schmidt | 259/95 |
| 2,469,825 | 5/1949 | Hornstein | 366/165 |
| 3,491,949 | 1/1970 | Hairston | 259/95 |
| 3,531,093 | 9/1970 | Karpacheva | 366/165 |

FOREIGN PATENT DOCUMENTS

| | | | |
|---|---|---|---|
| 434960 | 5/1946 | Canada | 259/95 |
| 594594 | 3/1934 | Fed. Rep. of Germany | 259/95 |
| 1190437 | 4/1965 | Fed. Rep. of Germany | 259/95 |
| 979344 | 1/1965 | United Kingdom | 259/95 |
| 1027846 | 4/1966 | United Kingdom | 259/95 |
| 1160444 | 8/1969 | United Kingdom | 259/95 |
| 1168423 | 10/1969 | United Kingdom | 259/95 |

*Primary Examiner*—Robert W. Jenkins

*Attorney, Agent, or Firm*—Wofford, Fails & Zobal

[57] ABSTRACT

A system for mixing fluids such as drilling fluids and which comprises an elongated container having a cylindrical shaped bottom. An interior conduit is located in the container along its axis and has a plurality of spaced apart inductor inlets along its length for the passage of fluid from the container into the conduit. An exterior conduit extends along the length of the container and has a plurality of spaced apart injection conduits extending into the container for injecting fluid therein in a direction to cause the fluid to swirl around the interior conduit. A pump has its inlet coupled to one end of the interior conduit and its outlet coupled to one end of the exterior conduit to cause the fluid in the container to spiral inward for flow through the inductor inlets into the interior conduit and to be pumped into the exterior conduit for injection through the injection conduits back into the container.

47 Claims, 9 Drawing Figures

Fig. 1
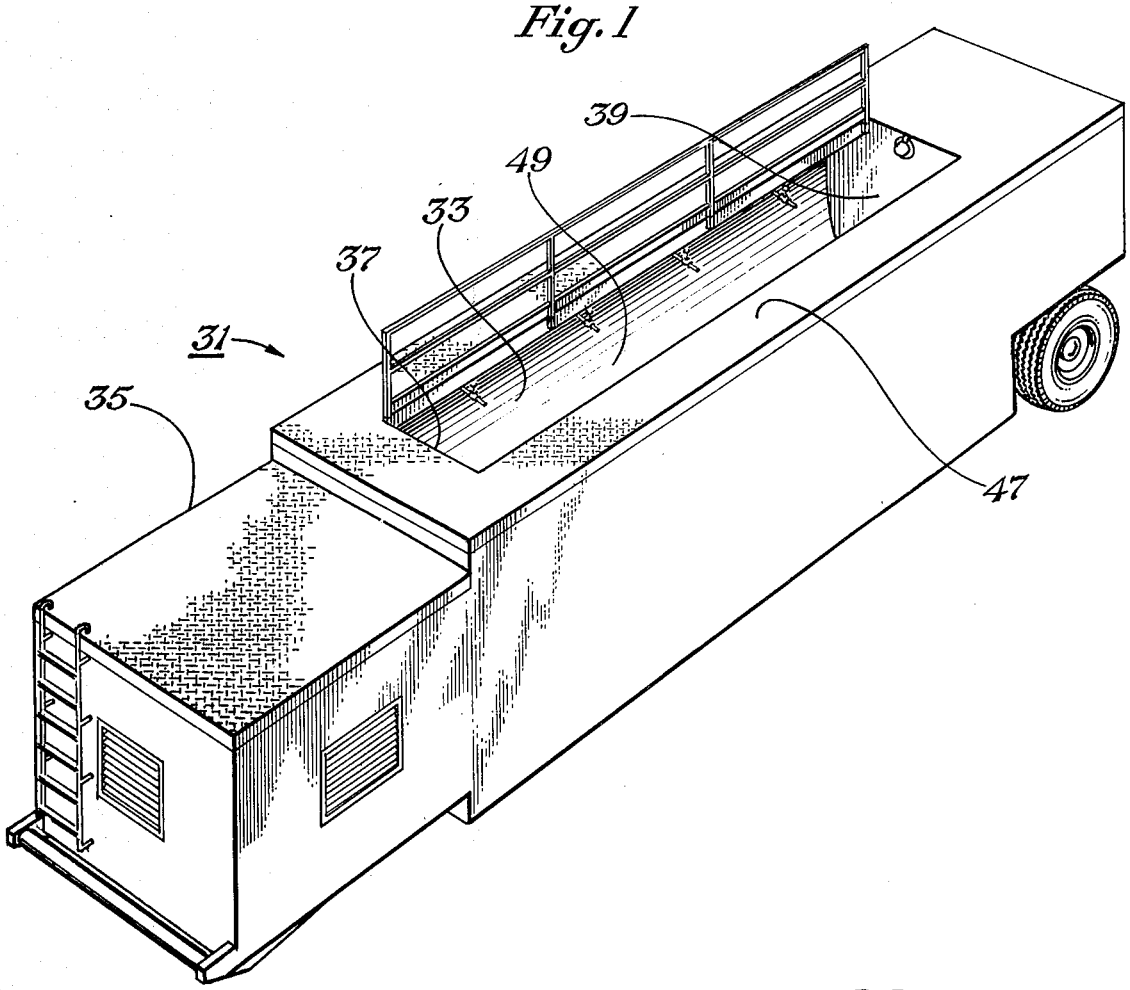
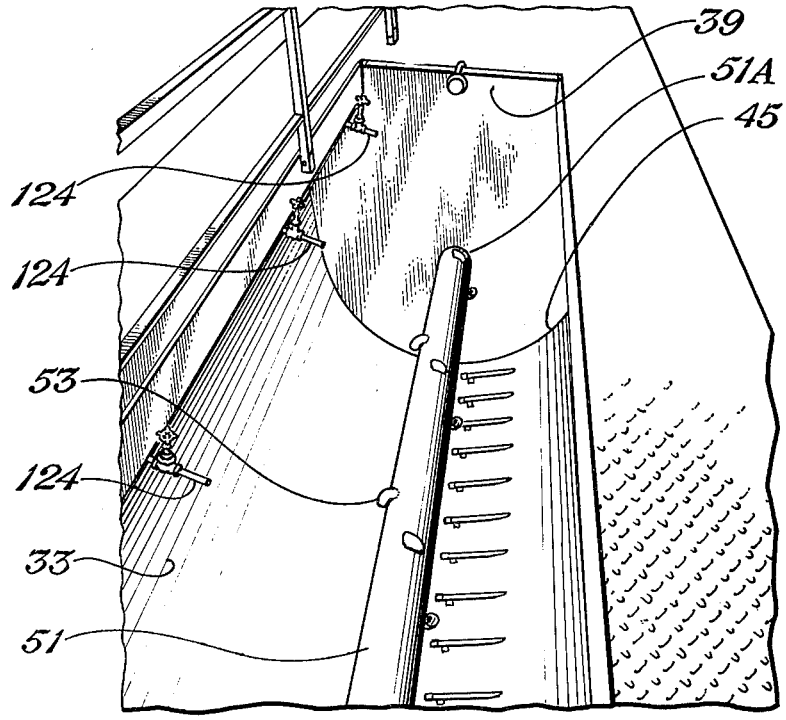
Fig. 2

Fig. 4
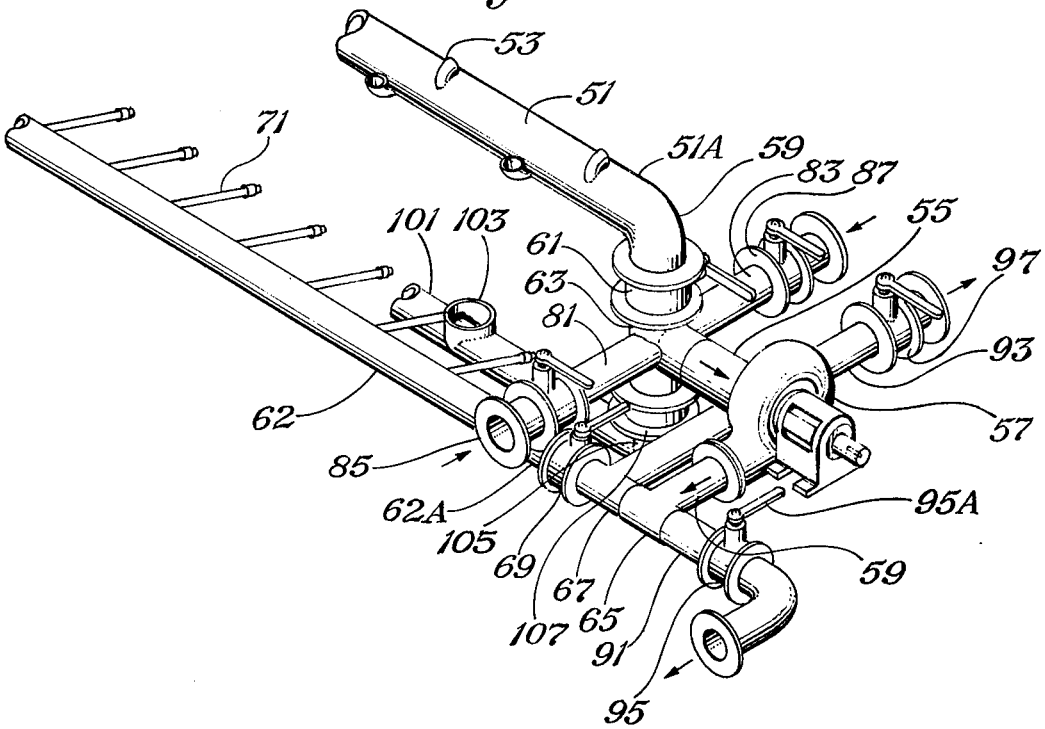
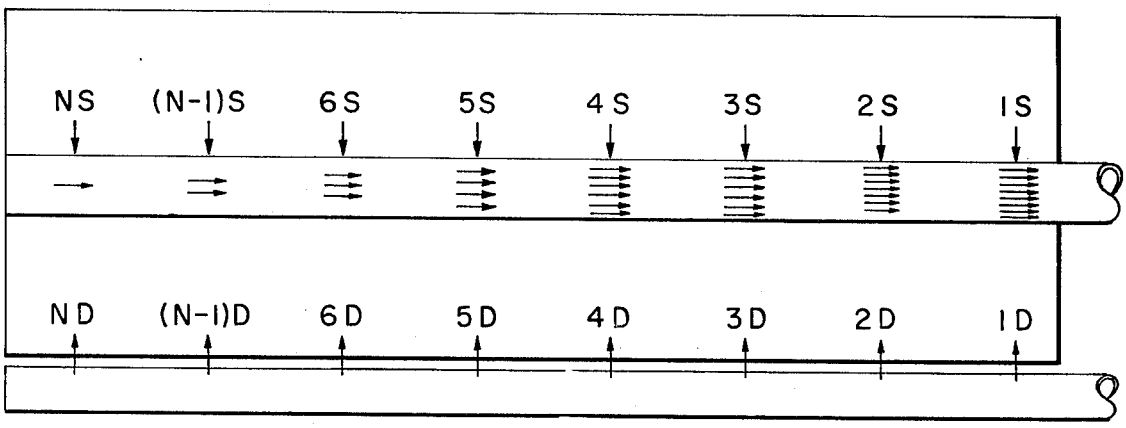
Fig. 6

Fig. 8
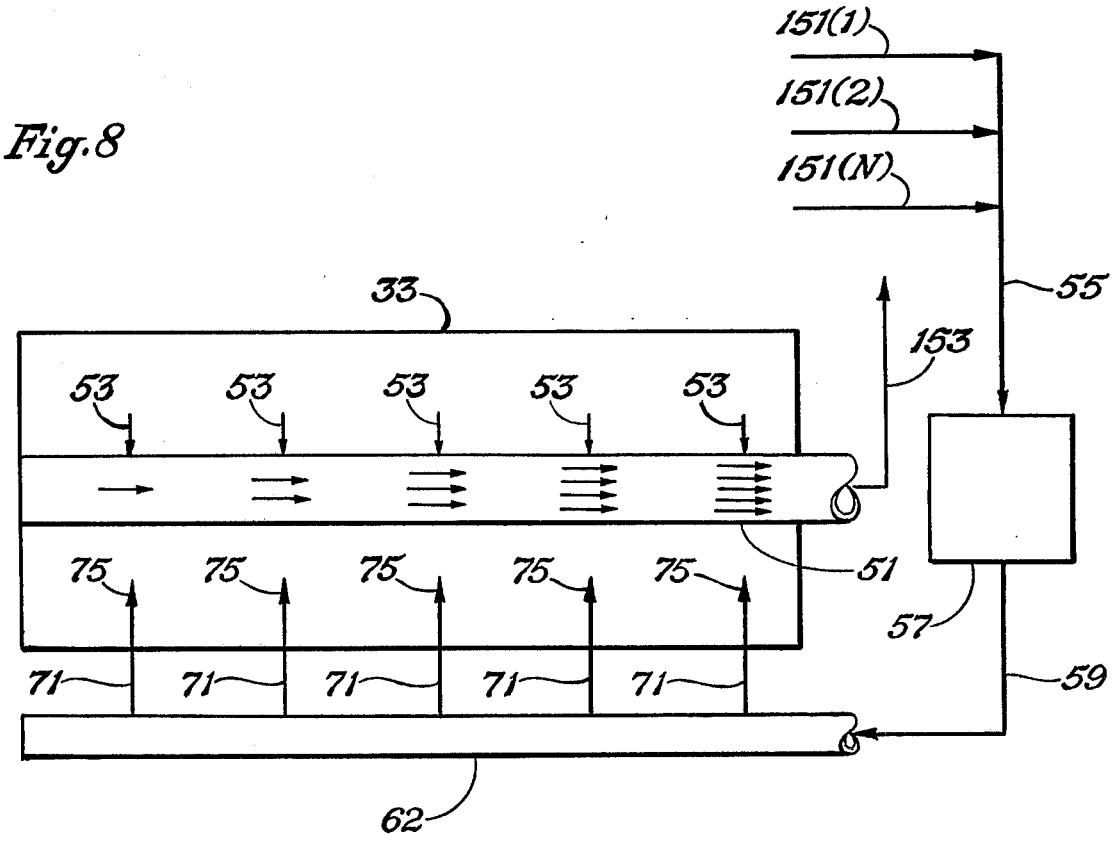
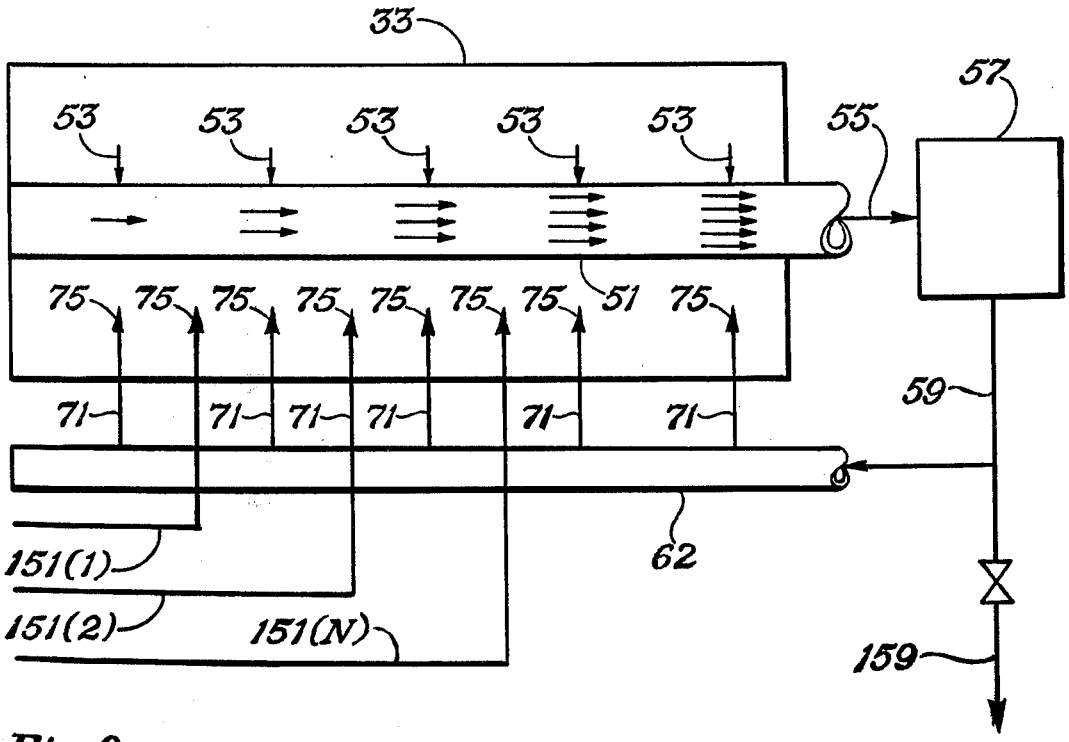
Fig. 9

FLUID MIXING SYSTEM

This application is a continuation-in-part of U.S. patent application Ser. No. 722,668 filed Sept. 13, 1976 now abandoned.

BACKGROUND OF THE INVENTION

Present mud mixing systems consume excessive time to properly blend drilling fluids. Also, the preparation of packer fluids and workover fluids require excessive time. This has disadvantages from the standpoint of cost. In addition while preparing a drilling fluid, drilling cannot proceed. In the case of lost circulation, considerable time can be lost preparing sufficient drilling fluid as needed. In the case of a blow out, the speed of obtaining a properly weighted drilling fluid quickly can mean the difference between an oil well fire or saving the well.

SUMMARY OF THE INVENTION

It is an object of the present invention to provide a fluid mixing system for rapidly and effectively mixing materials such as chemicals or particles with a liquid to form a desired fluid for the drilling industry or other purposes.

In one aspect, the fluid mixing system comprises a container having a given length for holding the fluid to be mixed. Injection means is provided for injecting fluid into the container at a plurality of spaced apart positions along the length. Conduit means is provided having inlet means for the flow of fluid from said container into said container. In addition pump means is provided for withdrawing fluid from said conduit means and for flowing said withdrawn fluid into said injection means for injection back into said container.

In a further aspect, said injection means injects fluid into the container at a plurality of spaced apart positions along its length and in a direction to cause the fluid to swirl around a central axis extending along the length of the container. Said conduit means is located in the container generally along its central axis and has a plurality of spaced inlet means along its length for the flow of fluid from the container into said conduit means.

In the embodiment disclosed, the container is defined by two spaced apart end walls, side wall portions, and a rounded bottom wall portion extending between said end walls. The injection means comprises second conduit means extending along the length of the container on the outside thereof and having a plurality of spaced apart injection conduit means coupled to said second conduit means and which extend into the container. The injection conduit means are positioned to inject fluid into the container in a direction to cause the fluid to follow a swirling path around said conduit means located in said container. The pump means has its inlet coupled to one end of said conduit means located in said container and its outlet coupled to one end of said second conduit means.

BRIEF DESCRIPTION OF THE DRAWINGS

FIG. 1 is a perspective view of the mixing system of the present invention mounted in a mobile unit;

FIG. 2 is a view of FIG. 1 looking down into the container or vessel of the mixing system;

FIG. 4 is a perspective view of the pumping and circulating system used in the mixing system but with the container of FIGS. 1–3 removed for purposes of clarity;

FIG. 6 schematically illustrates fluid flow from the exterior header into the central suction conduit located in the container of the mixing system;

FIG. 8 is a schematic view of a continuous mixing system; and

FIG. 9 is a schematic view of a continuous mixing system with recirculation.

DETAILED DESCRIPTION OF THE INVENTION

Figure 3:
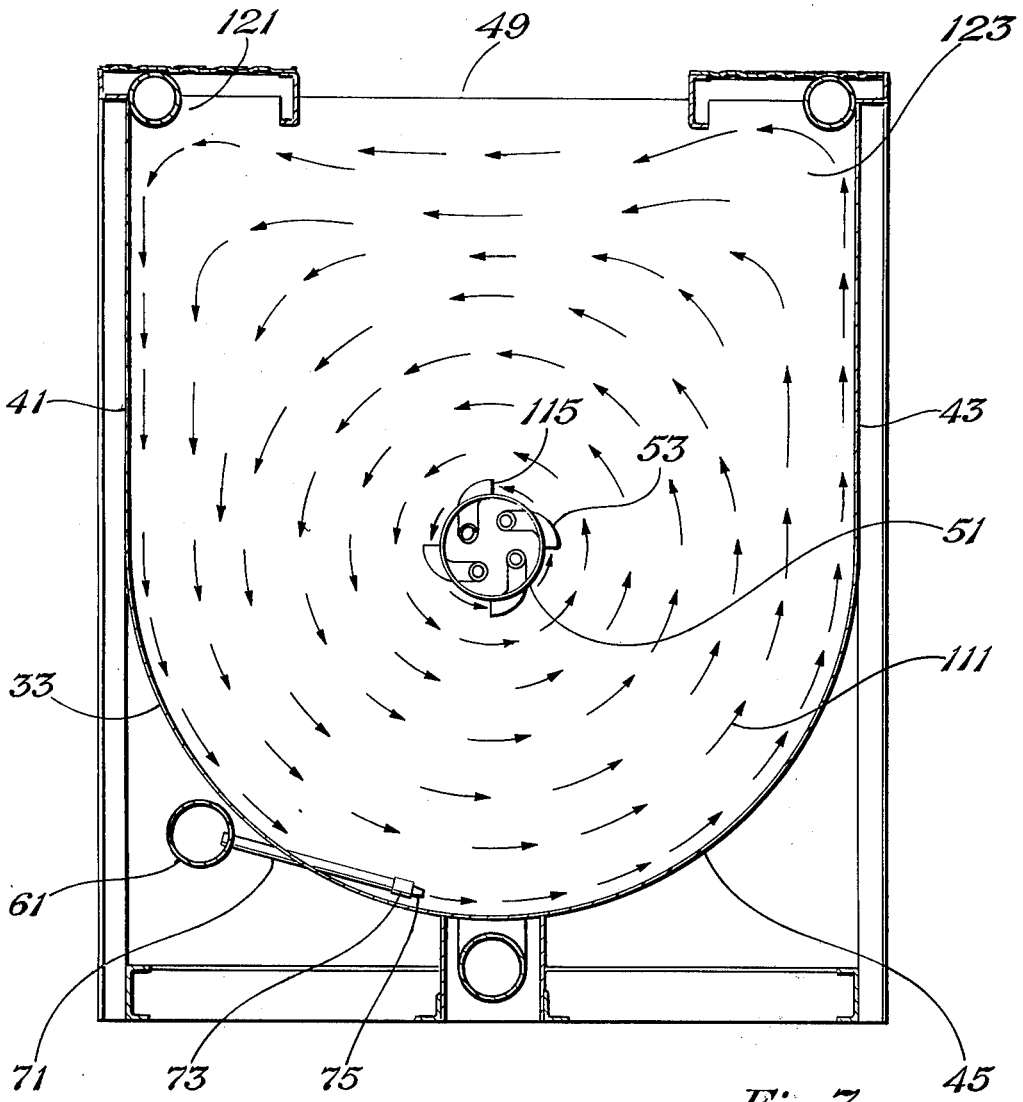
FIG. 3 is a cross-sectional view of the container of FIGS. 1 and 2.

Referring now to the drawings, the fluid mixing system is identified at 31 and comprises a fluid container or vessel 33 and a mixing system for preparing drilling fluids for the drilling industry although it may be employed for preparing fluids for other uses. The drilling fluid prepared may be water based or oil based and may be prepared by mixing chemicals or other particles with water or oil to obtain a homogenous solution or a heterogenous mixture.

The container 33 is supported by a mobile unit 35. It is elongated and is formed by two spaced apart end walls 37 and 39, two side walls 41 and 43 and a rounded bottom 45 extending between the end walls. The bottom 45 forms half of a cylinder. The side walls are straight and extend upward from opposite edges of the bottom. A top wall 47 is connected to the upper edges of the end walls 37 and 39 and side walls 41 and 43. Formed through the top wall 47 is a rectangular shaped opening 49 through which the material to be mixed may be dumped or pumped into the container.

Located in the container 33 and extending along its central axis is a suction pipe or conduit 51. The suction conduit extends from end wall 37 to end wall 39 and has a plurality of inductor inlets 53 equally spaced apart along its length. End 51A of the conduit 51 is coupled to the inlet 55 of a centrifugal pump 57 which is located on the exterior of the container. Connection of the suction conduit 51 to the inlet 55 is by way of an elbow 59, a valve 61 and a conduit joint 63.

The outlet 59 of the pump 57 is coupled to one end 62A of a conduit or header 62 which is also located on the exterior of the container 33 and extends along the length thereof. Connection of the outlet 59 to the header 62 is by way of conduit 65, conduit 67, and valve 69. Extending from the conduit 62 are a plurality of spaced apart injector conduits 71 which extend into the container 33 for injecting fluid into the container. The injector conduits 71 are equally spaced apart and are equal in number to the number of inductor conduits 53. The ends of the injector conduits have couplings 73 attached thereto to which are attached injector nozzles 75. As seen in FIG. 3 the injector conduits 71 extend into the container 33 tangentially with respect to the curved bottom wall 45.

Also coupled to the conduit joint 63 and hence to the inlet 55 of the pump are two external intake conduits 81 and 83. Valves 85 and 87 are connected to the conduits 81 and 83 respectively. Two external discharge conduits 91 and 93 are coupled to the outlet 59 of the pump 57. In this respect, discharge conduit 91 is coupled to the outlet 59 by way of conduit 65 and discharge conduit 93 is coupled to the outlet 59 by way of conduits 67 and 65. Valves 95 and 97 are connected to conduits 91 and 93 respectively.

A lower suction conduit 101 is located below the container and has a plurality of inlets 103 which are in fluid communication with the bottom of the container 33. Only one inlet 103 is shown although preferably there will be four of such inlets. The lower suction conduit 101 is connected to the inlet 55 of the pump by way of an elbow 105, a valve 107 and conduit joint 63.

In operation, the chemicals or particles to be mixed with a liquid are dumped into the container either manually or by way of hopper (not shown). Chemicals also may be pumped into the container. Either of the external intakes 81 or 83 will be connected to the source of liquid (oil or water) to be mixed with the chemical or particles added into the container. Assume that external intake 81 is connected to a liquid source. In addition either or both of the external discharge conduits 91 or 93 will be connected to the facility to which the mixed fluid is to be transported. Assume that external discharge conduit 91 is connected to a mud pump which in turn is connected to a well into which drilling fluid is to be injected. Initially all of the valves 61, 69, 85, 87, 95, 97 and 107 will be closed. These valves may be opened or closed by operating the levers shown. For example, the operating lever of valve 95 is identified at 95A. Valves 69 and 85 will be opened and the pump 57 started to cause the liquid to be pumped from the external intake 81 to the conduit 61. Flow is by way of external intake 81, conduit joint 63, pump intake 55, pump 57, pump outlet 59, conduit 65, conduit 67, valve 69 and then to header conduit 62. From the header 62 the liquid is injected into the container by way of the injection conduits 71. The container 33 is filled until the liquid reaches a desired level above the center suction conduit 51 dependent upon the calculated ratio of liquid to chemicals or particles to be mixed. When the container has been filled to the desired level valve 85 is closed and valve 61 opened. This causes the liquid in the container to flow through the inductor inlets 53 and into the suction conduit 51 and then to the pumped back into the header 62 and injected back into the container by way of the injector conduits 71. Flow from the center suction conduit 51 is by way of elbow 59, valve 61, conduit joint 63, pump inlet 55, pump 57, pump outlet 59, conduit 65 conduit 67, valve 69, header 62 and injection conduits 71. Thus, the liquid is circulated from the container into the inductor inlets and through the center section conduit 51, the pump, the header 62, and back into the container by way of the injector conduits 71. As stated above, the injector conduits are located such that fluid is injected from their nozzles tangentially to the curvature of the container bottom whereby the fluid injected follows a circular path around the container and hence around the center section conduit 51 as depicted by the arrows 111.

Figure 5:
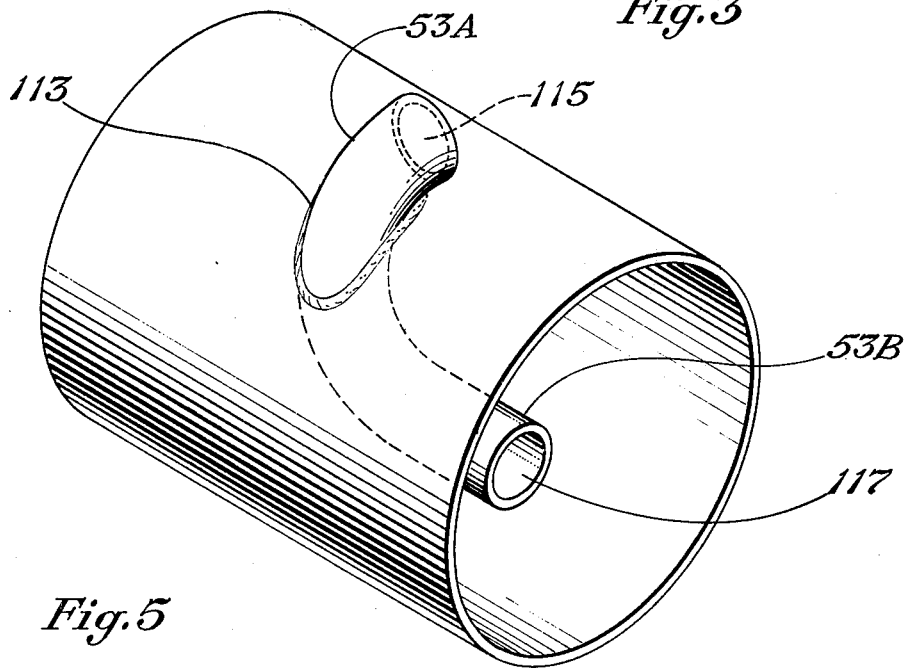
FIG. 5 is an enlarged perspective view of a portion of the central suction pipe or conduit employed in the container of FIGS. 1–3 and which illustrates one of the inductor inlets.

The fluid injected into the circular path causes the fluid in the tank to swirl with it whereby a secondary flow is induced and a sweep action is obtained across the bottom of the container which prevents chemicals or other materials from settling to the container bottom. The suction drawn on the suction conduit 51 by the centrifugal pump causes the fluid in the container 33 to spiral inward around the suction conduit. As the fluid spins inward the velocity increases and a pressure drop is experienced between the exterior and interior wall of the suction conduit 51 which would be detrimental to the quantity of fluid pumped through the suction conduit 51 if the inductor inlets 53 were merely perforations formed in the wall of the suction conduit 51. The effect of the pressure drop is overcome by the use of the inductor conduits 53. Referring to FIG. 5 each inductor conduit comprises a conduit 53 extending through an opening 113 formed in the wall of the suction conduit 51 and has a portion 53A located outside of the suction conduit 51 and a portion 53B located inside of the suction conduit. The exterior portion 53A is turned to have its opening 115 facing in a direction opposite the direction of flow of the fluid around the suction conduit 51 such that a pressure impact is created against the opening 115 of the inductor 53. Thus, velocity is converted to pressure and the effect of the pressure drop is overcome whereby a large quantity of fluid may be pumped through the suction conduit 51. The outlet of conduit portion 53A into conduit 51 is off center with respect to the axis of conduit 51. In order to prevent the fluid flowing through conduit 53A from swirling inside conduit 51 and to start the fluid flowing to the pump, the inside portion 53B of the inductor has its opening 117 facing in the direction of the flow of the fluid in the suction conduit 51 to the centrifugal pump as seen in FIG. 5.

In one embodiment, 24 inductors 53 and 24 injector conduits 71 are employed. The inductors 53 are equally spaced apart and are each of the same size whereby an equal quantity of fluid will be extracted through the suction conduit 51 at 24 equally spaced locations along the length of the suction conduit. This is depicted by FIG. 6 where NS represents the number of inductors and ND represents the number of injector conduits. The flow at IS will be comprised of N number of components from the container at N locations. This action will promote the establishment of a homogenous mixture flowing from the container through the suction conduit 51. The fluid will be further mixed by passing through the pump 57 due to turbulence or high shearing caused by the blades or vanes of the centrifugal pump. The injector conduits 71 are equally spaced apart and the injector conduits including their nozzles 75 are of the same size. Thus, from the pump, each quantity of fluid has an equal chance of being injected through any one of the 24 equally spaced apart injector conduits which promotes further mixing.

Inside the container 33, turbulence is created at the upper corners 121 and 123 due to the fact that these corners are not rounded. This is desirable since it enhances mixing of the chemicals or particles and the liquid. Extraction of a better mixed fluid from the container also is achieved by locating the suction conduit 51 in the center rather than at the periphery of the container. In this respect, if the extracting suction conduit 51 were located at the periphery of the container, a large mass of rotating fluid would exist in the center which would not be properly mixed whereby maximum mixing would not be achieved.

As indicated above, it has been assumed in this example that the external discharge conduit 91 is connected to a mud pump which in turn is connected to the drill pipe inside of a well into which drilling fluid is to be injected. When the liquid has been mixed properly, valves 107 and 95 are opened and valves 69 and 61 are closed whereby the fluid in the container is pumped to the external discharge conduit 91 by way of inlets 103, lower suction conduit 101, elbow 105, valve 107, conduit joint 63, inlet 55, pump 57, outlet 59, and conduit 65. Since the lower suction conduit 101 is located below the bottom of the container, 100% of the fluid can be evacuated from the container leaving nothing in the container which is important if the fluid is expensive which generally is the case for drilling fluid.

Location of the header conduit 62 outside rather than inside the container has advantages since it avoids the collection of materials (which do not go into solution) behind the header which would otherwise occur if the header were located in the container next to its wall. Although the header 62 is disclosed as being located at the bottom of the container it is to be understood that it could be located at other positions as long as secondary flow can be induced to achieve a sweep across the bottom of the container to prevent chemicals from dropping out and settling to the bottom.

Examples of chemicals which may be mixed with water or oil in the present system to form drilling fluids are as follows: Barium sulfate, Calcium carbonate, high yielding clay, sodium chloride, etc. Examples of other materials which may be mixed with oil or water in the present system to form a drilling fluid are ground paper, walnut hulls, mica, cotton seed, etc.

In one embodiment, the container 33 has a length of 24 feet, a height of 8½ feet and a width of 7½ feet. The capacity of the container is 215 barrels of liquid with a top liquid level one foot below the top of the container and 255 barrels at full capacity. Suction tube 51 has a diameter of about 10 inches and the header 62 has a diameter of about 8 inches. The inductors 52 are spaced one foot apart and each has a diameter of two inches. The injection conduits 71 are spaced one foot apart. Each injection conduit 71 is a one inch schedule 80 rated pipe with a coupling threaded thereto and a nozzle threaded into the coupling. The diameter of each nozzle is the same and may be from ⅝ to 0.957 inch. The lower suction pipe 101 has a diameter of 8 inches and has four equally spaced inlets 103. The centrifugal pump 57 is a Byron Jackson centrifugal pump having a 6 inch diameter outlet and an 8 inch diameter inlet. It has a hydraulic horsepower output of 110 h.p. at 1800 rpm with water, and a water rating of nearly 2000 gallons per minute. It is run at about 1800 rpm by a 4-71 Detroit diesel having an output of about 160 h.p. This embodiment of the fluid mixer can change out the entire content of the container 33 in four minutes and 12 seconds which is approximately 12 times faster than any known mixer in existance.

It is to be understood that the mixing system may have dimensions other than that disclosed above and employ a pump with a different flow and pressure rating.

Although the bottom 45 of the container 33 preferably is cylindrical in shape it could have other curved shapes to promote streamline flow. In addition, although the pump 57 is a centrifugal pump other types of pumps could be used such as a piston type pump, a gear pump, etc.

In some cases, it may be desirable to mix only a small quantity of liquid with a desired amount of chemical or particles such that the liquid desired to be mixed does not reach to the level of the suction conduit 51. In this case, the lower suction conduit 101 will be used rather than the central suction conduit 51 to extract the liquid from the container for re-circulation to the container by way of the pump 57, the header 61 and the injection conduits 71. Assuming that the chemical or particles have been dumped into the container and the container filled with liquid to the desired level, mixing is carried out by opening valves 107 and 69 to extract the fluid from the container by way of the inlets 103, the lower suction conduit 101, the pump 57, and then to re-inject the fluid into the container through the header 62 and the injection conduits 71. In this case, valves 61 will be closed during the circulation and hence mixing operation. After mixing has been achieved, the fluid is pumped from the container to the desired facility in the same manner described above with respect to the preferred embodiment.

The purpose of the top header jet conduits 121 is to wet lost circulation material during mixing which may float on top of the liquid. The jet conduits 121 are connected to a top header (not shown) which is connected to the pump outlet 59 by means not shown, whereby a portion of the fluid injected through the outlet 59 will be injected through the top header and then injected into the container by way of the jet conduits 121. In most instances the top header and jet conduits 121 will not be used.

Figure 7:
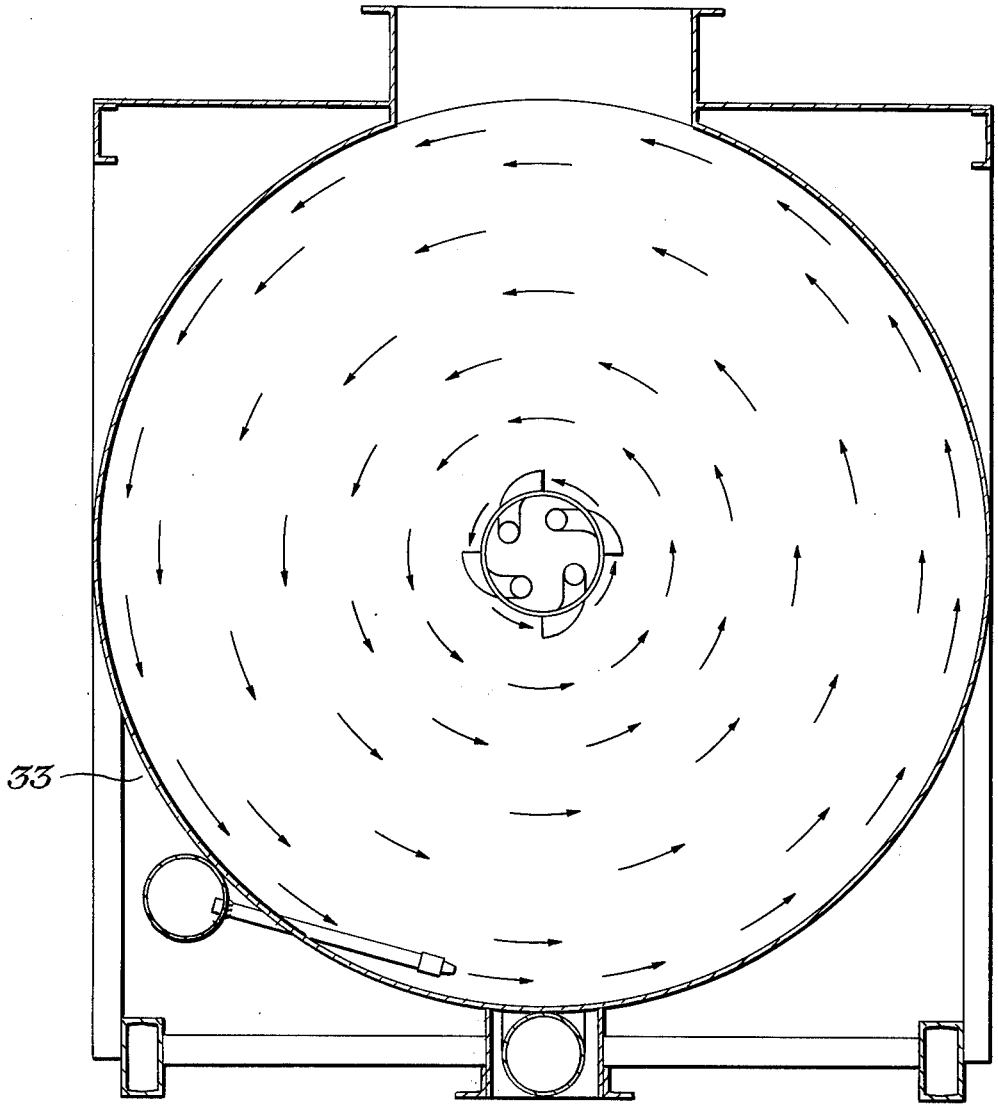
FIG. 7 is a cross-sectional view of a modified container which may be employed in the mixing system.

Referring to FIG. 7, there is disclosed another embodiment wherein the container 33 is in the form of a cylinder and does not have the straight upper side walls and top as does the embodiment of FIG. 1. This system operates in the same manner as that of the embodiment of FIG. 1, however, the turbulence at the upper corners 121 and 123 is eliminated since these right-angle corners have been eliminated. Thus, the embodiment of FIG. 7 will achieve maximum flow through the pump where maximum shearing occurs on the fluid due to the rotating action of the blades or vanes of the centrifugal pump.

In certain instances, it may be desirable to provide vortex generators in the container of the embodiment of FIG. 7 to obtain swirl or turbulence to enhance mixing of the chemicals or particles with the liquid. Such vortex generators may comprise a piece of metal with a helical twist, located to cause a secondary swirl in the direction of flow to create more shear and hence turbulence.

Although it is desirable to have turbulence within the container 33 it is more desirable to have an even flow around the suction conduit 51. This is achieved by locating the various inductors 53, 90° apart. It is to be understood, however, that the inductors could be all lined up with respect to each other if desired. In the preferred embodiment, the number of inductors 53 are equal to the number of injectors 71, however, in some cases the number of inductors may not be equal to the number of injectors. Similarly, in the preferred embodiment, the inductors 53 and the injectors 71 are equally spaced apart, however, in some cases they may not be equally spaced apart.

The system disclosed is a batch mixing system where the fluid in the container 33 is re-circulated through the pump 57 and back to the container 33. A continuous mixing system may be employed wherein the input 55 to the pump 57 is connected to an external fluid source and the output of the pump 57 is connected to the header 62. The output of the center conduit 51 will be connected to an external destination. The system will be operated as described previously, however, the fluid will not be re-circulated but will be mixed and then directly supplied to an external destination for its intended purpose. Such a system may be used in the chemical industry, sewage treatment, etc.

FIG. 8 is a schematic view of a continuous mixing system. In the embodiment of FIG. 8, like reference numerals identify like components as that shown in FIGS. 1-6. In the system of FIG. 8, the input 55 of the pump 57 is connected to one or more liquid conduits (151(1), 151(2), 151(N) and the output 59 of the pump 57 is connected to the header 62. The output of the center conduit 51 is connected to an external destination by way of conduit 153. The chemicals or particles to be mixed with a liquid are dumped into the container 33 either manually or by way of a hopper (not shown). Chemicals also may be pumped into the container. One or more types of liquids are fed to pump input 55 by way of conduits (151(1), 151(2), 151(N). The mixed fluid discharged through conduit 153 will be discharged at the same rate at which the various materials and liquids are added to the container 33.

FIG. 9, is a schematic view of another continuous mixing system wherein recirculation also is achieved. In the embodiment of FIG. 9 like reference numerals identify like components as that shown in FIGS. 1-6 and 8. In the system of FIG. 9, the chemicals or particles to be mixed with a liquid are dumped into the container 33 either manually or by way of a hopper (not shown). Chemicals also may be pumped into the container. One or more types of liquids are fed into the container by way of conduits 151(1), 151(2), 151(N). The output of center conduit 51 is coupled to the input 55 of the pump 57 and the output 59 of the pump 57 is fed back to header 62 and to an external source by way of conduit 159. The mixed fluid discharged through conduit 159 will be discharged at the same rate at which the various materials and liquids are added to the system.

Mixing will take place in the container 33 as described previously. As equal quantities of fluid are induced into the center conduit 51 at N number of locations, there will be presented a representative quantity of the container contents to the pump input 55 regardless of zoning of a particular material at its point of introduction into the container. Any fluctuation of the rate of material addition to the tank will tend to be dampened out.

In the embodiments of FIGS. 1-9, heat may be added to the fluid by heating and container 33 by blowing hot on the container 33. Agitation also adds heat. Heat may be extracted from the fluid by cooling the container 33 with suitable means.

I claim:

1. A fluid mixing system comprising:

a container having a given length, injection means for injecting fluid into said container at a plurality of spaced apart positions along its length and in a direction to cause the fluid to swirl around a central axis extending along the length of said container, conduit means located in said container generally along said central axis and having a plurality of spaced apart inlet means along its length for the flow of fluid from said container into said conduit means, and means for withdrawing fluid from said conduit means and for flowing said withdrawn fluid into said injection means for injection back into said container.

2. The system of claim 1 wherein each of said inlet means comprises:

an inductor conduit having a portion located outside of said conduit means with an opening facing in the direction opposite the direction of flow of said fluid around said conduit means.

3. A fluid mixing system comprising:

a container defined by two spaced apart end walls with side wall portions and a rounded bottom wall portion extending between said end walls, the distance between said end walls defining the length of said container, first conduit means located in said container at a generally central position relative to said side wall and bottom wall portions and extending along the length of said container, said first conduit means having a plurality of spaced apart inlet means along its length for providing a plurality of spaced apart flow passages from the interior of said container into said first conduit means, second conduit means extending along the length of said container, a plurality of spaced apart injection conduit means coupled to said second conduit means and located to inject fluid in a direction to cause said fluid to follow a swirling path around said first conduit means, and pump means having an inlet coupled to one end of said first conduit means and an outlet coupled to one end of said second conduit means to cause the fluid in said container to spiral toward around said first conduit means for flow through said plurality of said inlet means into said first conduit means and to be pumped from said first conduit means into said second conduit means for flow back into said container by way of said plurality of injection conduit means.

4. The system of claim 3 wherein:

each of said inlet means comprises an inductor conduit having a portion outside of said first conduit means with an opening which faces in a direction opposite the direction of flow of said fluid around said first conduit means, each of said inductor conduits leads into said first conduit means.

5. The system of claim 4 wherein:

each of said inductor conduits has a portion which extends into said first conduit means and which has an opening which faces said one end of said first conduit means to which said inlet of said pump means is coupled.

6. The system of claim 3 wherein:

said second conduit means is located on the exterior of said container, said plurality of injection conduit means extend from said second conduit means into said container in a direction to inject fluid into said container to initially follow generally the curvature of said rounded bottom wall.

7. The system of claim 6 wherein:

said pump means comprises a centrifugal pump.

8. The system of claim 3 wherein:

said rounded bottom wall portion defines part of a cylinder.

9. The system of claim 8 wherein:

said side wall portions extend straight upward from opposite sides of said bottom wall portion, said container has a generally flat top wall portion which is connected to the top edges of said end walls and said side wall portions.

10. The system of claim 8 wherein:

said container is generally cylindrical in shape.

11. A fluid mixing system comprising:

a container defined by two spaced apart end walls and side wall means comprising a rounded side wall portion extending between said end walls, the distance between said end walls defining the length of said container, injection means for injecting fluid into said container at a plurality of spaced apart positions along its length and in a direction to cause the fluid to swirl around said side wall means, conduit means located in said container at a generally central position relative to said side wall means and extending along the length of said container, said conduit means having a plurality of spaced apart inlet means along its length for providing a plurality of spaced apart flow passages from the interior of said container into said conduit means, and pump means having an inlet coupled to one end of said conduit means and an outlet coupled to said injection means to cause the fluid in said container to spiral inward around said conduit means for flow through said plurality of said inlet means into said conduit means and to be pumped from said conduit means to said injection means for injection back into said container.

12. The fluid mixing system of claim 11 wherein said injection means comprises:

second conduit means located on the outside of said container and extending along the length thereof, and a plurality of spaced apart injection means coupled to said second conduit means and extending into said container.

13. The fluid mixing system of claim 11 wherein each of said inlet means comprises:

an inlet conduit having a portion outside of said conduit means with an opening which faces in a direction opposite the direction of flow of said fluid around said conduit means, each of said inlet conduits being in fluid communication with the interior of said conduit means.

14. The fluid mixing system of claim 13 wherein said injection means comprises:

second conduit means located on the outside of said container and extending along the length thereof, and a plurality of spaced apart injection means coupled to said second conduit means and extending into said container.

15. A fluid mixing system comprising:

a container defined by two spaced apart end walls with side wall portions and a rounded bottom wall portion extending between said end walls, the distance between said end walls defining the length of said container, first conduit means located in said container at a generally central position relative to said side wall portions and bottom wall portion and extending along the length of said container, said first conduit means having a plurality of spaced apart inlet means along its length for providing a plurality of spaced apart flow passages from the interior of said container into said first conduit means, second conduit means extending along the length of said container, a plurality of spaced apart injection conduit means coupled to said second conduit means and located to inject fluid in a direction to cause said fluid to follow a swirling path around said first conduit means, means for injecting fluid into said second conduit means, and means coupled to the output of said first conduit means for receiving fluid flowing into said first conduit means by way of said flow passages.

16. The system of claim 15 wherein said means for injecting fluid into said second conduit means comprises:

pump means having an input and an output, means for applying fluid from an external source to said input of said pump means, said output of said pump means being coupled to said second conduit means.

17. The fluid mixing system of claim 15 wherein:

each of said inlet means comprises an inlet conduit having a portion outside of said first conduit means with an opening which faces in a direction opposite the direction of flow of said fluid around said first conduit means, each of said inlet conduits being in fluid communication with the interior of said first conduit means.

18. A fluid mixing system comprising:

a container defined by two spaced apart end walls with side wall portions and a rounded bottom wall portion extending between said end walls, the distance between said end walls defining the length of said container, first conduit means located in said container at a generally central position relative to said side wall portions and bottom wall portion and extending along the length of said container, said first conduit means having a plurality of spaced apart inlet means along its length for providing a plurality of spaced apart flow passages from the interior of said container into said first conduit means, second conduit means extending along the length of said container, a plurality of spaced apart injection conduit means coupled to said second conduit means and located to inject fluid in a direction to cause said fluid to follow a swirling path around said first conduit means, means for applying fluid from an external source into said container, output conduit means, and pump means having an input and an output, said input of said pump means being coupled to said first conduit means for receiving fluid flowing into said first conduit means by way of said flow passages, said output of said pump means being coupled to said second conduit means and to said output conduit means.

19. The fluid mixing system of claim 18 wherein: ;p1 each of said inlet means comprises an inlet conduit having a portion outside of said first conduit means with an opening which faces in a direction opposite the direction of flow of said fluid around said first conduit means, each of said inlet conduits being in fluid communication with the interior of said first conduit means.

20. A fluid mixing system comprising:

a container defined by two spaced apart end walls with side wall portions and a rounded bottom wall portion extending between said end walls, the distance between said end walls defining the length of said container, first conduit means located in said container at a generally central position relative to said side wall and bottom wall portions and extending along the length of said container, said first conduit means having a plurality of equally spaced apart inlet means along its length for providing a plurality of equally spaced apart flow passages from the interior of said container into said first conduit means, second conduit means located on the exterior of said container and extending along the length thereof, a plurality of equally spaced apart injection conduit means coupled to said second conduit means and extending into said container to inject fluid in a direction to cause said fluid to follow a swirling path around said first conduit means, and pump means located on the exterior of said container and having an inlet coupled to one end of said first conduit means and an outlet coupled to one end of said second conduit means to cause the fluid in said container to spiral inward around said first conduit means for flow through said plurality of said inlet means into said first conduit means and to be pumped from said first conduit means into said second conduit means for flow back into said container by way of said plurality of injection conduit means.

21. The fluid mixing system of claim 20 wherein the number of said injection conduit means equals the number of said inlet means.

22. The fluid mixing system of claim 21 comprising:

a discharge conduit means coupled to said outlet of said pump means, and valve means coupled to said discharge conduit means for controlling the flow of fluid through said discharge conduit means.

23. A fluid mixing system comprising:

a container defined by two spaced apart end walls with side wall portions and a rounded bottom wall portion extending between said end walls, the distance between said end walls defining the length of said container, first conduit means located in said container at a generally central position relative to said side wall and bottom wall portions and extending along the length of said container, said first conduit means having a plurality of spaced apart inlet means along its length for providing a plurality of spaced apart flow passages from the interior of said container into said first conduit means, second conduit means located on the exterior of said container and extending along the length thereof, a plurality of spaced apart injection conduit means coupled to said second conduit means and located to inject fluid in a direction to cause said fluid to follow a swirling path around said first conduit means, third conduit means located below said container and having inlet means coupled to the bottom of said container, pump means having an inlet coupled to one end of said first conduit means and to one end of said third conduit means, said pump means having an outlet coupled to one end of said second conduit means, and valve means for selectively controlling the flow of fluid from said first conduit means to said inlet of said pump means or from said third conduit means to said inlet of said pump means.

24. The fluid mixing system of claim 23 wherein: said valve means comprises:

first valve means coupled between said one end of said first conduit means and said inlet of said pump means for controlling the flow of fluid from said first conduit means to said inlet of said pump means, and second valve means coupled to said third conduit means and to said inlet of said pump means for controlling the flow of fluid from said third conduit means to said inlet of said pump means, said fluid mixing system comprising:

third valve means coupled between said outlet of said pump means and said one end of said second conduit means for controlling the flow of fluid from said outlet of said pump means to said second conduit means, fluid discharge conduit means coupled to said outlet of said pump means, and fourth valve means coupled to said fluid discharge conduit means for controlling the flow of fluid from said outlet of said pump means through said fluid discharge conduit means.

25. A fluid mixing system comprising:

a container defined by two spaced apart end walls and side wall means comprising a rounded bottom wall portion extending between said end walls, the distance between said end walls defining the length of said container, conduit means located in said container at a generally central position relative to said side wall means and extending along the length of said container, said conduit means having a plurality of spaced apart inlet means along its length for providing a plurality of spaced apart flow passages from the interior of said container into said conduit means, injection means for injecting fluid into said container at a plurality of spaced apart positions along its length and in a direction to cause the fluid to follow a swirling path around said conduit means, and pump means having an inlet coupled to said conduit means and an outlet coupled to said injection means to cause the fluid in said container to spiral inward around said conduit means for flow through said plurality of said inlet means into said conduit means and to be pumped from said conduit means into said injection means for flow back into said container by way of said injection means.

26. The fluid mixing system of claim 25 comprising:

lower conduit means coupled to the bottom of said container means for removing fluid from said container.

27. The fluid mixing system of claim 26 comprising:

first valve means coupled between said one end of said conduit means and said inlet of said pump means for controlling the flow of fluid from said conduit means to said inlet of said pump means, second valve means coupled to said lower conduit means and to said inlet of said pump means for controlling the flow of fluid from said lower conduit means to said inlet of said pump means, third valve means coupled between said outlet of said pump means and said injection means for controlling the flow of fluid from said outlet of said pump means to said injection means, fluid discharge conduit means coupled to said outlet of said pump means, and fourth valve means coupled to said fluid discharge conduit means for controlling the flow of fluid from said outlet of said pump means through said fluid discharge conduit means.

28. The fluid mixing system of claim 25 wherein:

each of said inlet means comprises an inlet conduit having a portion outside of said conduit means with an opening which faces in a direction opposite the direction of flow of said fluid around said conduit means, each of said inlet conduits being in fluid communication with the interior of said conduit means.

29. The system of claim 28 comprising:

lower conduit means coupled to the bottom of said container for removing fluid from said container.

30. A fluid mixing system comprising:

a container defined by two spaced apart end walls and side wall means comprising a rounded side wall portion extending between said end walls, the distance between said end walls defining the length of said container, injection means for injecting fluid into said container at a plurality of spaced apart positions along its length and in a direction to cause the fluid to swirl around said side wall means, conduit means located in said container along the length thereof at a position closer to the axis of said rounded wall portion than to said side wall means, said conduit means having a plurality of spaced apart inlet means along its length for the flow of fluid from said container into said conduit means, and pump means having an inlet coupled to said conduit means and an outlet coupled to said injection means to cause the fluid in said container to spiral inward around said conduit means for flow through said plurality of said inlet means into said conduit means and to be pumped from said conduit means to said injection means for flow back into said container.

31. The fluid mixing system of claim 30 wherein:

said rounded side wall portion defines part of a cylinder.

32. The fluid mixing system of claim 30 wherein:

said container is generally cylindrical in shape.

33. The fluid mixing system of claim 30 wherein:

each of said inlet means comprises an inlet conduit having a portion outside of said conduit means with an opening which faces in a direction opposite the direction of flow of fluid around said conduit means, each of said inlet conduits being in fluid communication with the interior of said conduit means.

34. The fluid mixing system of claim 30 wherein:

said rounded sided wall portion forms at least the bottom of said container.

35. The fluid mixing system of claim 34 comprising:

lower conduit means coupled to the bottom of said container for removing fluid from said container.

36. The fluid mixing system of claim 34 comprising:

lower conduit means coupled to the bottom of said container and to said inlet of said pump means, and valve means for selectively controlling the flow of fluid from said conduit means to said inlet of said pump means or from said lower conduit means to said inlet of said pump means.

37. A fluid mixing system comprising:

a container defined by two spaced apart end walls and side wall means comprising a rounded bottom wall portion extending between said end walls, the distance between said end walls defining the length of said container, injection means for injecting fluid into said container at a plurality of spaced apart positions along its length and in a direction to cause the fluid to swirl around said side wall means, conduit means located in said container along the length thereof at about the axis of said rounded bottom wall portion, said conduit means having a plurality of spaced apart inlet means along its length for the flow of fluid from said container into said conduit means, and pump means having an inlet coupled to said conduit means and an outlet coupled to said injection means to cause the fluid in said container to spiral inward around said conduit means for flow through said plurality of said inlet means into said conduit means and to be pumped from said conduit means to said injection means for flow back into said container.

38. The fluid mixing system of claim 37 wherein:

said rounded bottom wall portion forms part of a cylinder.

39. The fluid mixing system of claim 37 wherein:

said container is generally cylindrical in shape.

40. The fluid mixing system of claim 37 wherein:

each of said inlet means comprises an inlet conduit having a portion outside of said conduit means with an opening which faces in a direction opposite the direction of flow of fluid around said conduit means, each of said inlet conduits being in fluid communication with the interior of said conduit means.

41. The fluid mixing system of claim 37 comprising:

lower conduit means coupled to the bottom of said container for removing fluid from said container.

42. The fluid mixing system of claim 37 comprising:

lower conduit means coupled to the bottom of said container and to said inlet of said pump means, and valve means for selectively controlling the flow of fluid from said conduit means to said inlet of said pump means or from said lower conduit means to said inlet of said pump means.

43. A fluid mixing system comprising:

a container having a given length, injection means for injecting fluid into said container at a plurality of spaced apart positions along its length and in a direction to cause the fluid to swirl around an axis extending along the length of said container, conduit means located in said container near said axis and having an inlet means for the flow of fluid from said container into said conduit means, and means for withdrawing fluid from said conduit means and for flowing said withdrawn fluid into said injection means for injection back into said container.

44. The fluid mixing system of claim 43 wherein:

said container is defined by two spaced apart end walls with side wall portions and a rounded bottom wall portion extending between said end walls, the distance between said end walls defining the length of said container.

45. The fluid mixing system of claim 44 wherein:

said conduit means extends along the length of said container, said inlet means comprising a plurality of spaced apart inlets along said conduit means.

46. The fluid mixing system of claim 43 wherein:

said injection means is located near the wall of said container, said axis is located radially inward of said injection means.

47. The fluid mixing system of claim 43 wherein:

said conduit means extends along the length of said container, said inlet means comprising a plurality of spaced apart inlets along said conduit means.

* * * * *